US011024933B2

(12) United States Patent
Rawlings et al.

(10) Patent No.: US 11,024,933 B2
(45) Date of Patent: Jun. 1, 2021

(54) WAVEGUIDE COMPRISING AN EXTRUDED DIELECTRIC WAVEGUIDE CORE THAT IS COEXTRUDED WITH AN OUTER CONDUCTIVE LAYER

(71) Applicant: Intel Corporation, Santa Clara, CA (US)

(72) Inventors: Brandon M. Rawlings, Chandler, AZ (US); Shawna M. Liff, Scottsdale, AZ (US); Sasha N. Oster, Chandler, AZ (US); Georgios C. Dogiamis, Chandler, AZ (US); Telesphor Kamgaing, Chandler, AZ (US); Adel A. Elsherbini, Chandler, AZ (US); Aleksandar Aleksov, Chandler, AZ (US); Johanna M. Swan, Scottsdale, AZ (US); Richard J. Dischler, Bolton, MA (US)

(73) Assignee: Intel Corporation, Santa Clara, CA (US)

( * ) Notice: Subject to any disclaimer, the term of this patent is extended or adjusted under 35 U.S.C. 154(b) by 45 days.

(21) Appl. No.: 16/325,351

(22) PCT Filed: Sep. 30, 2016

(86) PCT No.: PCT/US2016/054837

§ 371 (c)(1),
(2) Date: Feb. 13, 2019

(87) PCT Pub. No.: WO2018/063342

PCT Pub. Date: Apr. 5, 2018

(65) Prior Publication Data

US 2019/0207290 A1 Jul. 4, 2019

(51) Int. Cl.
*H01P 3/16* (2006.01)
*H01P 3/12* (2006.01)
(Continued)

(52) U.S. Cl.
CPC ..... *H01P 3/16* (2013.01); *H01P 3/122* (2013.01); *H01P 3/123* (2013.01); *H01P 3/14* (2013.01);
(Continued)

(58) Field of Classification Search
CPC ..... H01P 3/16; H01P 11/006; H01P 3/12
(Continued)

(56) References Cited

U.S. PATENT DOCUMENTS 4,525,693 A * 6/1985 Suzuki et al. ..... H01P 3/16 156/184
6,803,841 B2 * 10/2004 Saitoh et al. ..... H01P 3/16 333/239
(Continued)

FOREIGN PATENT DOCUMENTS

EP 2006793 12/2008
WO WO-20180633421 A1 4/2018

OTHER PUBLICATIONS

"International Application Serial No. PCT/US2016/054837, International Search Report dated Apr. 25, 2017", 3 pgs.
(Continued)

*Primary Examiner* — Benny T Lee
(74) *Attorney, Agent, or Firm* — Schwegman Lundberg & Woessner, P.A.

(57) ABSTRACT

A method of making a waveguide, comprises: extruding a first dielectric material as a waveguide core of the waveguide, wherein the waveguide core is elongate; and coextruding an outer layer with the waveguide core, wherein the outer layer is arranged around the waveguide core.

23 Claims, 9 Drawing Sheets

(51) Int. Cl.
*H01P 3/123* (2006.01)
*H01P 3/14* (2006.01)
*H01P 11/00* (2006.01)

(52) U.S. Cl.
CPC ..... *H01P 11/002* (2013.01); *H01P 11/006* (2013.01)

(58) Field of Classification Search
USPC ..... 333/239
See application file for complete search history.

(56) References Cited

U.S. PATENT DOCUMENTS

| | | | | |
|---|---|---|---|---|
| 6,960,970 | B2 * | 11/2005 | Elco ..... | H01P 1/16 333/239 |
| 2003/0038690 | A1 | 2/2003 | Abe et al. | |
| 2010/0052827 | A1 | 3/2010 | Schneider et al. | |
| 2014/0097917 | A1 | 4/2014 | Shah et al. | |
| 2014/0368301 | A1 | 12/2014 | Herbsommer et al. | |
| 2016/0064795 | A1 | 3/2016 | Chang et al. | |
| 2017/0040659 | A1 * | 2/2017 | Morgan et al. ..... | H01P 3/16 |

OTHER PUBLICATIONS

"International Spplication Serial No. PCT/US2016/054837, Written Opinion dated Apr. 25, 2017", 11 pgs.
"International Application Serial No. PCT US2016 054837, International Preliminary Report on Patentability dated Apr. 11, 2019", 13 pgs.

* cited by examiner

WAVEGUIDE COMPRISING AN EXTRUDED DIELECTRIC WAVEGUIDE CORE THAT IS COEXTRUDED WITH AN OUTER CONDUCTIVE LAYER

CLAIM OF PRIORITY

This patent application is a U.S. National Stage Application under 35 U.S.C. 371 from International Application No. PCT/US2016/054837, filed Sep. 30, 2016, published as WO2018/063342, which is incorporated herein by reference.

TECHNICAL FIELD

Embodiments pertain to high speed interconnections in electronic systems, and more specifically to waveguides for implementing communication interfaces between electronic devices.

BACKGROUND

As more electronic devices become interconnected and users consume more data, the demand on server system performance continues to increase. More and more data is being stored in internet "clouds" remote from devices that use the data. Clouds are implemented using servers arranged in server clusters (sometimes referred to as server farms). The increased demand for performance and capacity has led server system designers to look for ways to increase data rates and increase the server interconnect distance in switching architectures while keeping power consumption and system cost manageable.

Within server systems and within high performance computing architectures there can be multiple levels of interconnect between electronic devices. These levels can include within blade interconnect, within rack interconnect, rack-to-rack interconnect and rack-to-switch interconnect. Shorter interconnect (e.g., within rack interconnect and some rack-to-rack interconnect) is traditionally implemented with electrical cables (e.g., Ethernet cables, co-axial cables, twin-axial cables, etc.) depending on the required data rate. For longer distances, optical cables are sometimes used because fiber optic solutions offer high bandwidth for longer interconnect distances.

However, as high performance architectures emerge (e.g., 100 Gigabit Ethernet), traditional electrical approaches to device interconnections that support the required data rates are becoming increasingly expensive and power hungry. For example, to extend the reach of an electrical cable or extend the bandwidth of an electrical cable, higher quality cables may need to be developed, or advanced techniques of one or more of equalization, modulation, and data correction may be employed which increases power of the system and adds latency to the communication link. For some desired data rates and interconnect distances, there is presently not a viable solution. Optical transmission over optical fiber offers a solution, but at a severe penalty in power and cost. The present inventors have recognized a need for improvements in the interconnection between electronic devices.

DETAILED DESCRIPTION OF THE INVENTION

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

Traditional electrical cabling may not meet the emerging requirements for electronic systems such as server clusters. Fiber optics may meet the performance requirements, but may result in a solution that is too costly and power hungry. A waveguide can be used to propagate electromagnetic waves including electromagnetic waves having a wavelength in millimeters (mm) or micrometers (μm). A transceiver and an antenna (sometimes referred to as a "waveguide launcher") can be used to send electromagnetic waves along the waveguide from the transmitting end. A transceiver at the receiving end can receive the propagated signals using a receiving end antenna (or waveguide launcher). Waveguides offer the speed and bandwidth needed to meet the emerging requirements. However, a waveguide that only includes hollow metal tubing can be difficult to work with as such waveguides can be prone to buckling or kinking when trying to apply the waveguide to a physical connector or if the connection requires bending of the waveguide.

Figure 1:
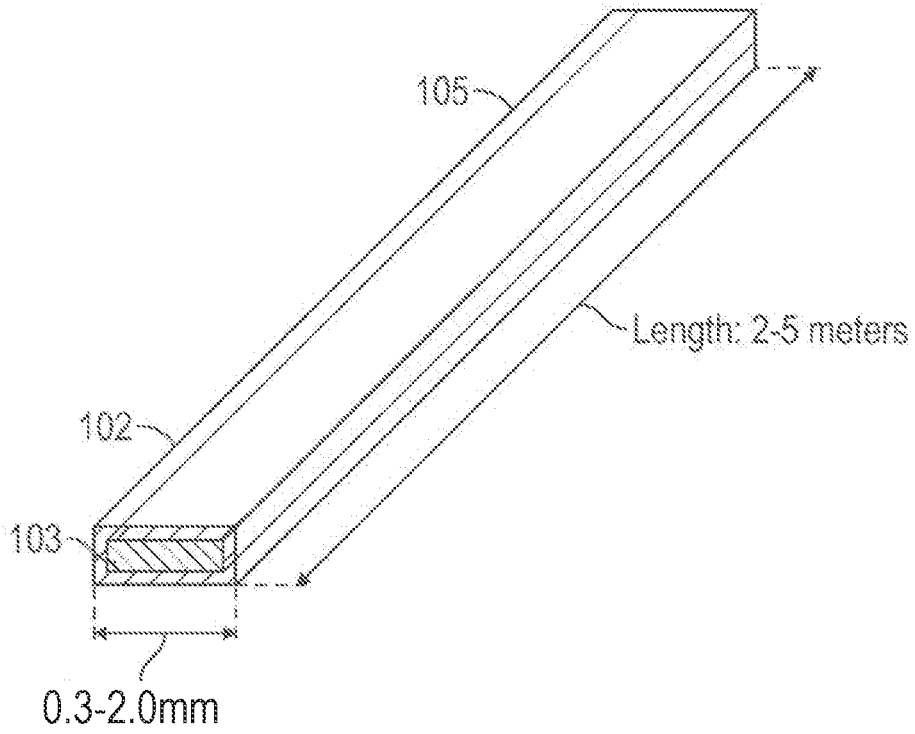
FIG. 1 is an illustration of a waveguide in accordance with some embodiments.

FIG. 1 is an illustration of an embodiment of a waveguide. The waveguide in the example has a rectangular cross section with a height of 0.3-2 millimeters (mm) and has a length of 2-5 meters (m). The waveguide 105 includes an outer layer 102 of electrically conductive material such as metal. The inside of the waveguide, or waveguide core 103, includes a dielectric material. A waveguide that includes a conductive layer and a waveguide core of dielectric material can reduce signal loss and improve mechanical support of the waveguide, but the integrity of the metal portion can still limit the bending radius achievable with the waveguide. Additionally, some dielectrics may manifest poor adhesion to metal sidewalls. The waveguide core can be formed by extrusion. Coextruding the outer layer of the waveguide with the dielectric waveguide core allows for better control of the conductor-dielectric interface.

Figure 2:
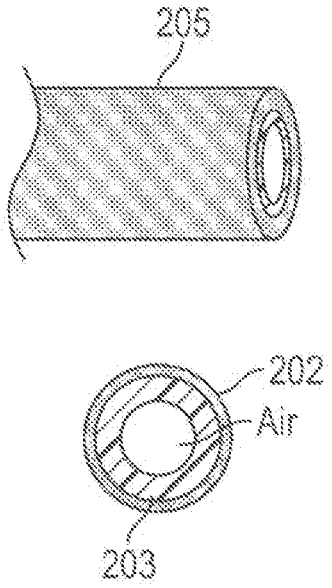
FIGS. 2 and 13-16 are illustrations of portions of waveguides in accordance with some embodiments.
Figure 13:
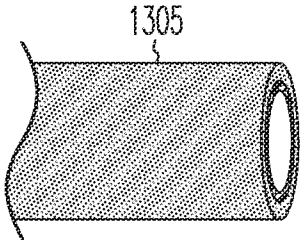
Figure 14:
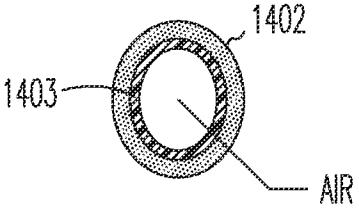
Figure 15:
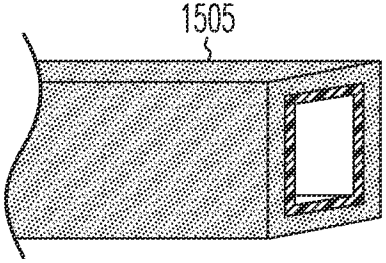
Figure 16:
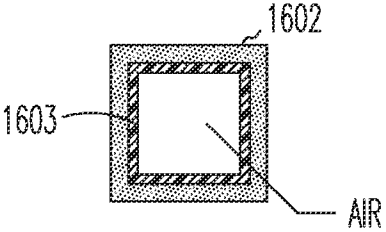

FIG. 2 is an illustration of a portion of another embodiment of a waveguide. The waveguide 205 includes an elongate waveguide core 203 and an outer layer 202. The waveguide has a circular cross section, but the cross section may be elliptical, oval, square, rectangular or another more complex geometry. FIGS. 13 and 14 are illustrations of a waveguide 1305 as shown in FIG. 13 having an oval or elliptical cross section with waveguide core 1403 including a hollow core that is air filled and outer layer 1402 as shown in FIG. 14. FIGS. 15 and 16 are illustrations of a waveguide 1505 as shown in FIG. 15 having a square cross section with waveguide core 1603 including a hollow core that is air filled and outer layer 1602 as shown in FIG. 16. The waveguide may have a width or diameter of 0.3-2.0 mm and a length greater than one-half meter (0.5 m). In certain variations, the waveguide may have a diameter larger than 2 mm. In certain embodiments, the waveguide is dimensioned to carry signals having frequencies of 30 Gigahertz (GHz) to 300 GHz. In certain embodiments, the waveguide is dimensioned to carry signals having frequencies of 100 GHz to 900 GHz. The waveguide core includes a dielectric material such as one or more of polyethylene (PE), polytetrafluoroethylene (PTFE), perfluoroalkoxy alkanes (PFA), fluorinated ethylene propylene (FEP), polyvinylidene fluoride (PVDF), or ethylene-tetraflouroethylene (ETFE). The waveguide core may be formed as a continuous tube using an extrusion process. The dielectric waveguide core shown in FIG. 2 has a hollow center (e.g. air filled) but the waveguide core may be solid without a hollow portion.

The outer layer 202 is a layer coextruded with the waveguide core and is arranged around the waveguide core. The cross section of the outer layer may be concentric with the cross section of the waveguide core. In contrast to other methods of forming the outer layer, the outer surface of the coextruded layer may show a flow pattern or surface lines from the co-extrusion. The co-extrusion can produce a robust interface between the outer layer and the waveguide core. The co-extrusion also allows for thin sub-one-mil (sub-1 mil) thicknesses of the outer layer 202 to give the resulting waveguide a tighter bending radius while minimizing asperities and stresses that may impact millimeter-wave signal propagation in the waveguide The outer layer 202 can include a conductive material such as a metal (e.g., at least one of copper, gold, silver, or aluminum) or a conductive polymer (e.g., at least one of a polyaniline (PANI) or poly(3,4-ethylenedioxythiophene) polystyrene sulfonate (PEDOT:PSS)). In some embodiments, the outer layer includes a metal coating that is formed after the co-extrusion process.

Figure 3:
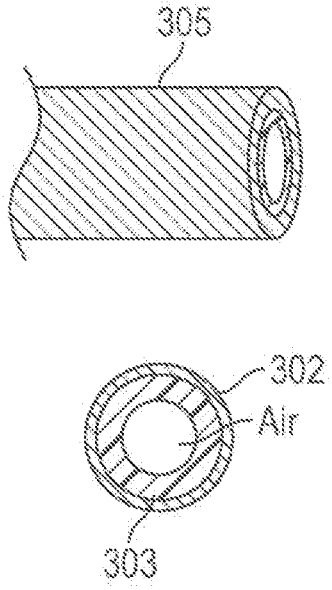
FIG. 3 is another illustration of portions of a waveguide in accordance with some embodiments.

FIG. 3 is an illustration of a portion of another embodiment of a waveguide. The waveguide 305 includes a coextruded outer layer 302 and waveguide core 303. The center of the waveguide core 303 may be hollow and include air. The coextruded outer layer 302 includes a metal particle filled polymer. The polymer can be a dielectric material that is the same as the waveguide core or can be a different dielectric material. A sintering process can be used to fuse the metal particles of the coextruded outer layer into a fused-metal continuous outer coating on the outer surface of the outer layer to provide a layer having high conductivity. The sintering process can include heat sintering, ultraviolet (UV) sintering, or infrared (IR) sintering. In variations, the outer layer may be dip-coated with the metal particles prior to the sintering process.

Figure 4:
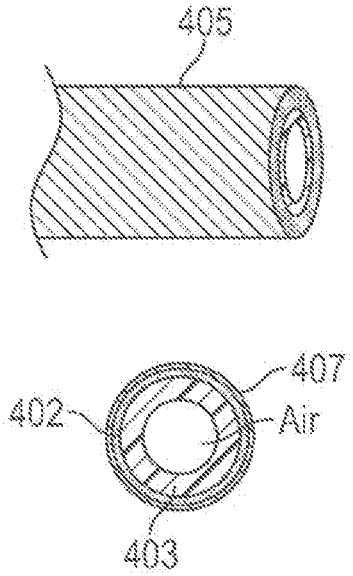
FIG. 4 is another illustration of portions of a waveguide in accordance with some embodiments.

FIG. 4 is an illustration of a portion of another embodiment of a waveguide 405. The waveguide includes a dielectric waveguide core 403 that may be hollow and mostly air-filled and a coextruded outer layer 402 that includes a metal catalyst to promote electroplating. For example, the coextruded outer layer can include carbon treated with palladium catalyst and then blended with a dielectric (e.g., PTFE). The palladium catalyst can be activated using UV exposure, and a thin 2-3 um coating can be formed or grown around the outer surface 407 of the outer layer of the waveguide with electroplating. In variations, the outer layer may be coated with a blend that includes the metal catalyst. In another example, the outer layer can be a blend with a dielectric and bronze or graphite particles, and the metal particles may serve as the conductive material in the outer layer or used as a seed particles for a subsequent electroplating process to form a thin metal outer surface on the outer layer of the waveguide.

Figure 5A:
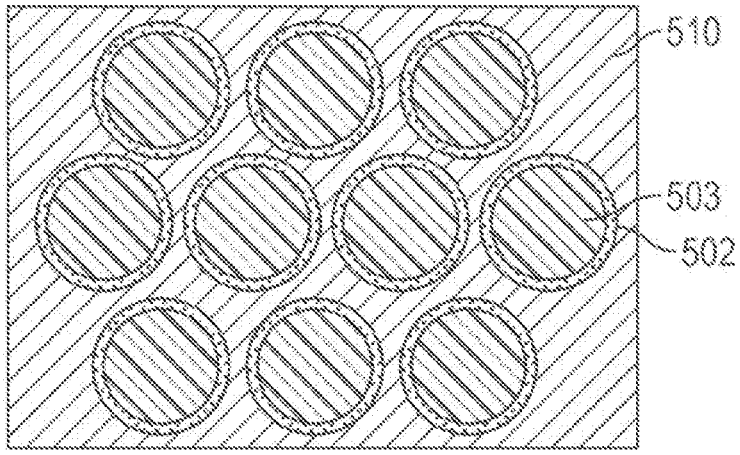
FIGS. 5A-5C are illustrations of multiple waveguides embedded in an outer shell in accordance with some embodiments.
Figure 5B:
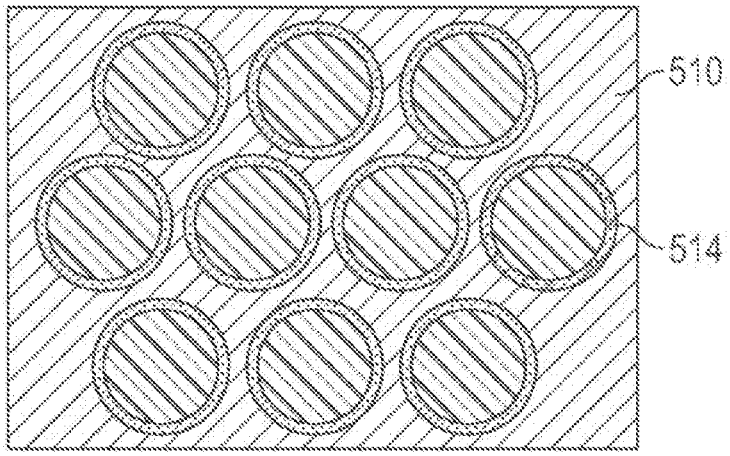
Figure 5C:
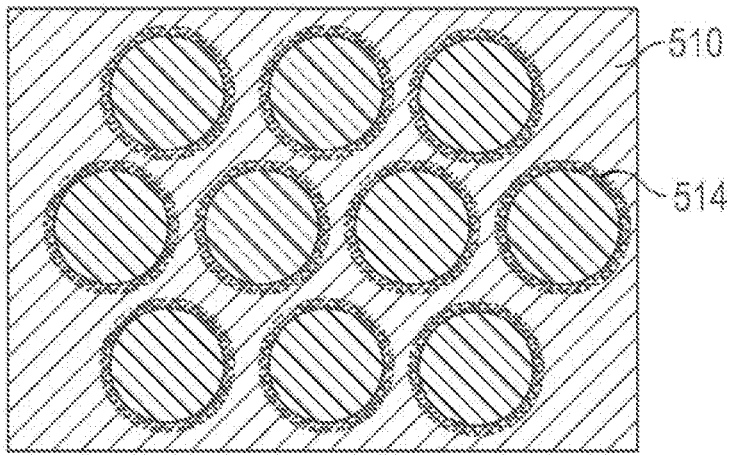

FIGS. 5A-5C are illustrations of multiple waveguides embedded in an outer shell of flexible material. In FIG. 5A, the waveguides are embedded in a flexible matrix (e.g., of polydimethylsiloxane (PDMS)) 510. The waveguides can include extruded waveguide cores 503 with coextruded outer layers 502. The waveguides can be arranged as a bundle with multiple layers of waveguides as shown in FIG. 5A, or arranged as a single layer or ribbon of waveguides. The waveguides can include a conductive outer layer as the waveguides are formed or the conductive layer can be formed after the waveguides are formed in the outer shell of flexible material.

Figure 6:
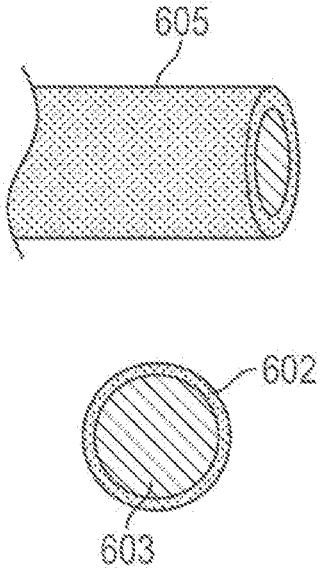
FIG. 6 is another illustration of portions of a waveguide in accordance with some embodiments.

FIG. 6 is an illustration of one of the waveguides 605 of the embedded waveguides of FIG. 5A. The waveguide core 603 includes a polymer having a low dielectric constant. The outer layer 602 can be a porous polymer shell, or can be a removable shell. To form a porous polymer shell, the outer layer can include a porogen filled material. As shown in the flexible matrix 510 of FIG. 5B, heating of the flexible outer shell and the porogen filled material can then create pores or regions void of the flexible material (e.g., air-filled) between the flexible material and the outer layer of the waveguides. To form a removable shell, the outer layer can include a removable layer. Heating or etching can remove all or portions of the removable layer to produce an outer layer that is void of the flexible material and composed mostly of air. In certain embodiments, the resulting air gap can be left intact to act as a stress buffer region. In some embodiments, as shown in FIG. 5C, the outer layers of the waveguides can be metalized after the void regions are formed. If the pores or void regions are large enough, the metallization can be formed using chemical vapor deposition. Alternatively, the outer layer can include a metal catalyst and electroplating can be used to metalize the outer surface 514 as shown in FIGS. 5B and 5C. Waveguide transceiver circuits or waveguide launchers can be operatively coupled to the waveguides that are embedded in the flexible material The several embodiments of coextruded waveguides can provide waveguides with thicknesses that give the resulting waveguide a tighter bending radius to the volume of a system implemented using mm waveguides. Another approach to improve bending radius is to add one or more notches in the waveguide cross section to accommodate the strain involved in bending the waveguides.

Figure 7:
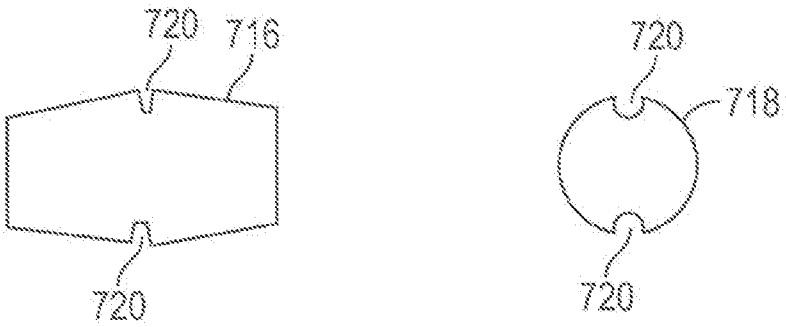
FIG. 7 are illustrations of cross sections of waveguides in accordance with some embodiments.
Figure 8:
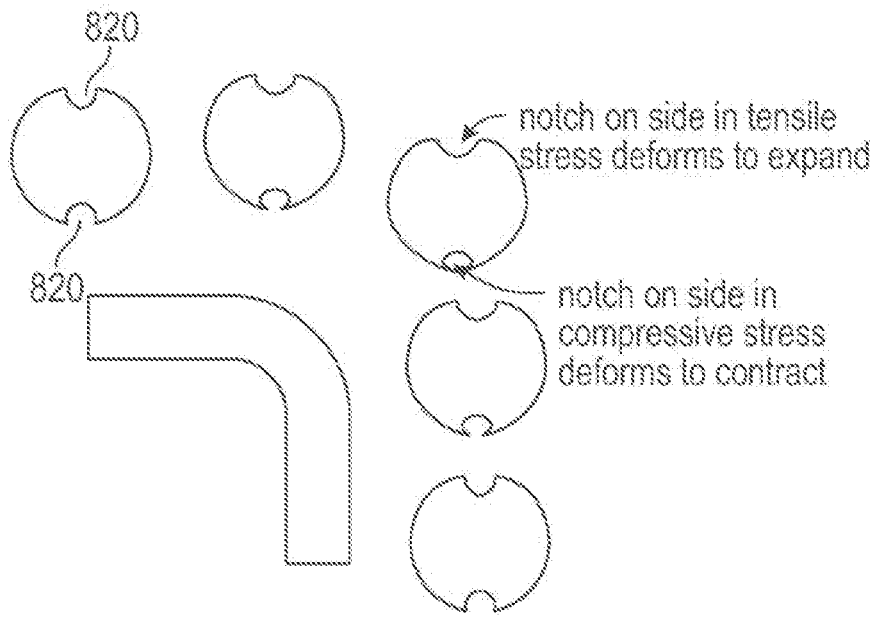
FIG. 8 is an illustration of waveguide deformation in accordance with some embodiments.

FIG. 7 are illustrations of a rectangular cross section 716 of a waveguide and a circular cross section of a waveguide 718. The cross section includes notches 720. The notches provide for controlling or managing the deformation caused by bending the waveguides. FIG. 8 is an illustration of how the notches 820 of the circular waveguides deform when the waveguide is subject to bending. The notch on the side that is in tensile stress deforms to expand the notch and the notch on the side that is in compressive stress deforms to compress or contract the notch. The remainder of the waveguide retains its shape.

The notches in the cross sections of FIG. 7 can correspond to grooves extending lengthwise along the waveguide. The waveguides can include conductive material (e.g., a metal) at the outer most layer thereof and the grooves can be included in the conductive material. The waveguides can be hollow as shown in FIG. 7 or can be filled or partially filled with a dielectric material for a waveguide core. Two grooves in the waveguide can be arranged opposite each other to create the first notch on a first side of the cross section in FIG. 7 and the second notch in the cross section opposite the first notch. In certain embodiments, the waveguide includes more than two grooves. If the waveguide includes a dielectric waveguide core, the conductive layer can be formed by coextruding the conductive layer with the dielectric core.

Figure 9:
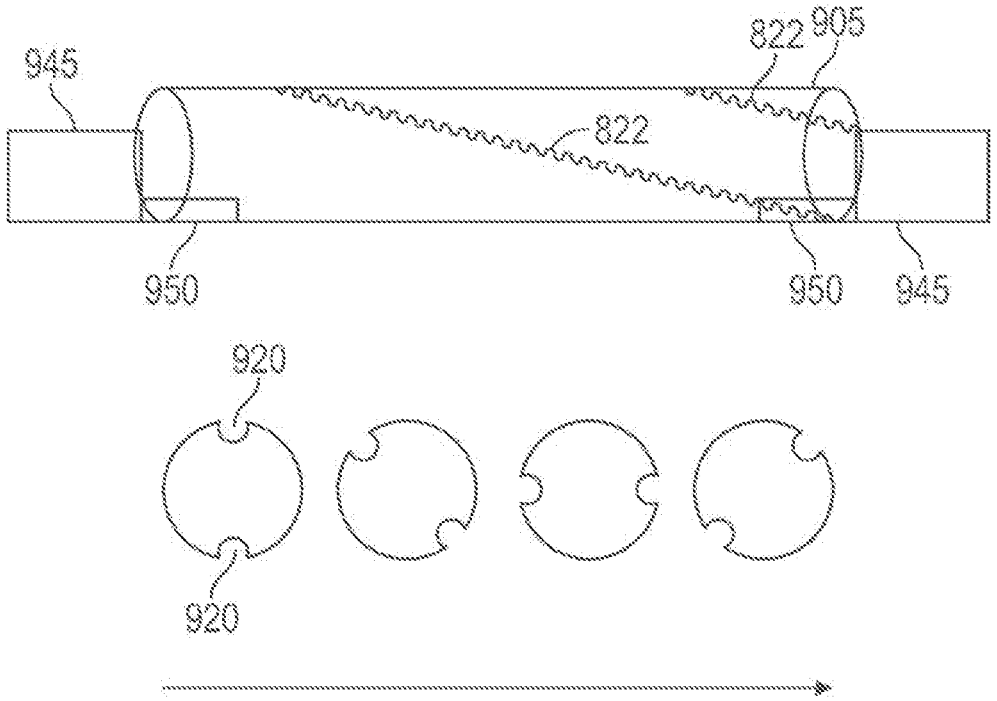
FIG. 9 is another illustration of portions of a waveguide in accordance with some embodiments.

In some embodiments, one or both of the direction and the size of the notches can be changed along the length of the waveguide to allow bending in multiple directions. FIG. 9 is an illustration of a waveguide 905 in which the position of the grooves change along the length of the waveguide. In the example in FIG. 9, the grooves 822 rotate around the waveguide to continually change along the length of the waveguide 905. This results in a continuous change in the position of the notches 920 in the cross section of the waveguide along the length of the waveguide. The waveguide 905 can be used to implement a bend in any of a multiple directions allowing one waveguide type to address multiple bend requirements in an implemented system.

The ends of the waveguide can be operatively connected to transceiver circuits 945 and antennas 950 (e.g., patch antennas) or waveguide launchers. The waveguide link can be used in establishing communication among servers in a server cluster or server farm. A waveguide transceiver circuits or waveguide launchers can be operatively coupled to the ends of the waveguide 905 to transmit electromagnetic waves around any bends in the waveguide link. The waveguide link can be used in establishing communication among servers in a server cluster or server farm.

Figure 10:
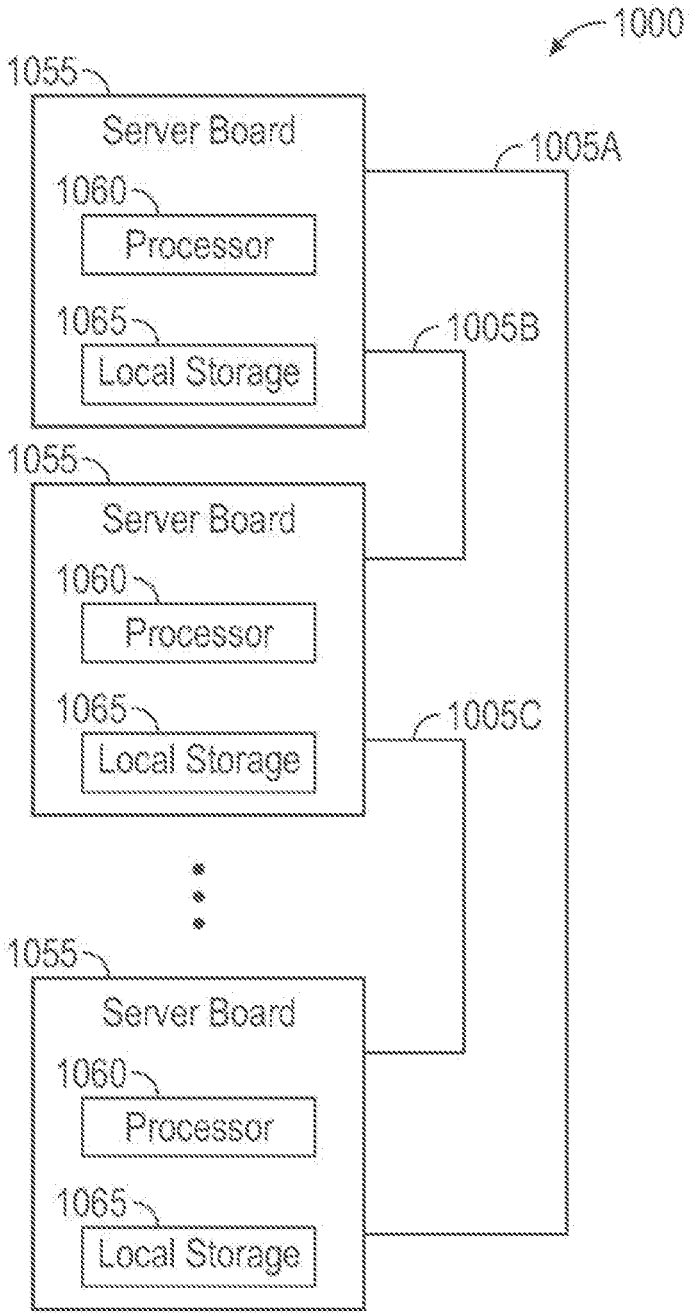
FIG. 10 is a block diagram of an electronic system in accordance with some embodiments.

FIG. 10 is a block diagram of an electronic system 1000 incorporating waveguide assemblies in accordance with at least one embodiment of the invention. Electronic system 1000 is merely one example in which embodiments of the present invention can be used. The electronic system 1000 of FIG. 10 comprises multiple servers or server boards 1055 interconnected as a server cluster that may provide internet cloud services. A server board 1055 may include one or more processors 1060 and local storage 1065. Only three server boards are shown to simplify the example in FIG. 10. A server cluster may include hundreds of servers arranged on boards or server blades in a rack of servers, and a server cluster can include dozens of racks of server blades. Racks can be placed side-by-side with a back-plane or back-panel used to interconnect the racks. Server switching devices can be included the racks of the server cluster to facilitate switching among the hundreds of servers.

The server boards in FIG. 10 are shown interconnected using three waveguides 1005A, 1005B, and 1005C, to simplify the Figure, although an actual system would include hundreds of rack-to-rack and within rack interconnections. The waveguides are operatively connected to ports of the servers. There can be multiple levels of interconnect between servers. These levels can include within server blade interconnect, within server rack interconnect, rack-to-rack interconnect and rack-to-switch interconnect. The waveguides 1005A, 1005B, and 1005C are used for at least a portion of the interconnect within the server system, and can be used for any of the within server blade, within server rack, rack-to-rack, and rack-to-switch interconnections. In certain embodiments, the waveguides form at least a portion of back-panel interconnections for a server cluster.

Figure 11:
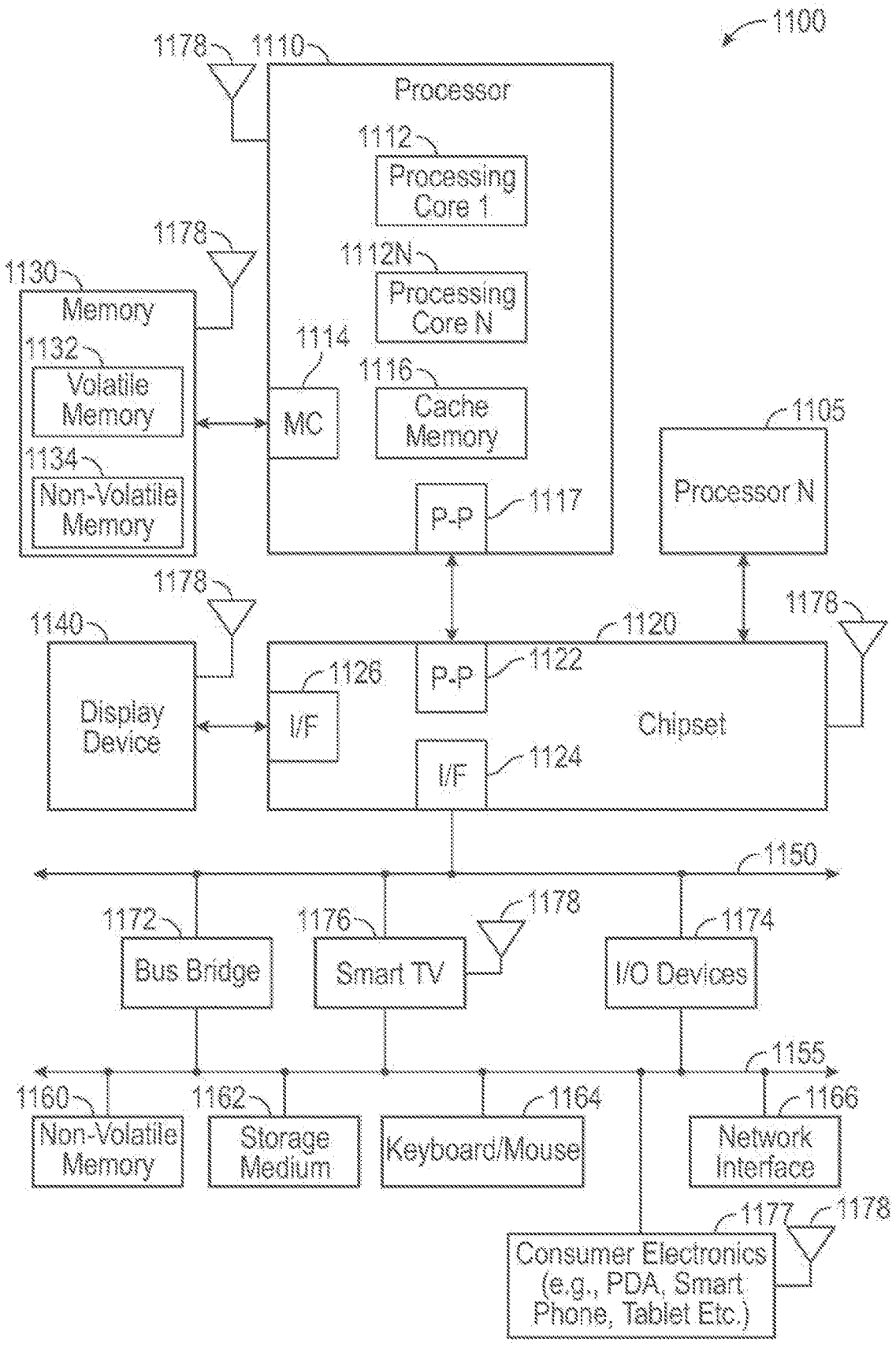
FIG. 11 is a block diagram of another electronic system in accordance with some embodiments.

FIG. 11 illustrates a system level diagram, according to one embodiment of the invention. For instance, FIG. 11 depicts an example of an electronic device (e.g., system) that can include the waveguide interconnections as described in the present disclosure. In one embodiment, system 1100 includes, but is not limited to, a desktop computer, a laptop computer, a netbook, a tablet, a notebook computer, a personal digital assistant (PDA), a server, a workstation, a cellular telephone, a mobile computing device, a smart phone, an Internet appliance or any other type of computing device. In some embodiments, system 1100 is a system on a chip (SOC) system. In one example two or more systems, as shown in FIG. 11 may be coupled together using one or more waveguides as described in the present disclosure. In one specific example, one or more waveguides as described in the present disclosure may implement one or more of busses 1150 and 1155.

In one embodiment, processor 1110 has one or more processing cores including processor core 11112 and processor core N 1112N, where 1112N represents the Nth processor core inside processor 1110 where N is a positive integer. In one embodiment, system 1100 includes multiple processors including processor 1110 and processor N 1105, where processor N 1105 has logic similar or identical to the logic of processor 1110. In some embodiments, processing core 1112 includes, but is not limited to, pre-fetch logic to fetch instructions, decode logic to decode the instructions, execution logic to execute instructions and the like. In some embodiments, processor 1110 has a cache memory 1116 to cache instructions and/or data for system 1100. Cache memory 1116 may be organized into a hierarchal structure including one or more levels of cache memory.

In some embodiments, processor 1110 includes a memory controller 1114 (MC), which is operable to perform functions that enable the processor 1110 to access and communicate with memory 1130 that includes a volatile memory 1132 and/or a non-volatile memory 1134. In some embodiments, processor 1110 is coupled with memory 1130 and chipset 1120. Processor 1110 may also be coupled to a wireless antenna 1178 to communicate with any device configured to transmit and/or receive wireless signals. In one embodiment, the wireless antenna interface 1178 operates in accordance with, but is not limited to, the IEEE 802.11 standard and its related family, Home Plug AV (HPAV), Ultra Wide Band (UWB), Bluetooth, WiMax, or any form of wireless communication protocol.

In some embodiments, volatile memory 1132 includes, but is not limited to, Synchronous Dynamic Random Access Memory (SDRAM), Dynamic Random Access Memory (DRAM), RAMBUS Dynamic Random Access Memory (RDRAM), and/or any other type of random access memory device. Non-volatile memory 1134 includes, but is not limited to, flash memory, phase change memory (PCM), read-only memory (ROM), electrically erasable programmable read-only memory (EEPROM), or any other type of non-volatile memory device.

Memory 1130 stores information and instructions to be executed by processor 1110. In one embodiment, memory 1130 may also store temporary variables or other intermediate information while processor 1110 is executing instructions. In the illustrated embodiment, chipset 1120 connects with processor 1110 via Point-to-Point (PtP or P-P) interfaces 1117 and 1122. Chipset 1120 enables processor 1110 to connect to other elements in system 1100. In some embodiments of the invention, interfaces 1117 and 1122 operate in accordance with a PtP communication protocol such as the Intel® QuickPath Interconnect (QPI) or the like. In other embodiments, a different interconnect may be used.

In some embodiments, chipset 1120 is operable to communicate with processor 1110, processor N 1105, display device 1140, and other devices 1172, 1176, 1174, 1160, 1162, 1164, 1166, 1177, etc. Buses 1150 and 1155 may be interconnected together via a bus bridge 1172. Chipset 1120 connects to one or more buses 1150 and 1155 that interconnect various elements 1174, 1160, 1162, 1164, and 1166. Chipset 1120 may also be coupled to a wireless antenna 1178 to communicate with any device configured to transmit and/or receive wireless signals. Chipset 1120 connects to display device 1140 via interface 1126 (I/F). Display 1140 may be, for example, a liquid crystal display (LCD), a plasma display, cathode ray tube (CRT) display, or any other form of visual display device. In some embodiments of the invention, processor 1110 and chipset 1120 are merged into a single SOC. In one embodiment, chipset 1120 couples with a non-volatile memory 1160, a mass storage medium 1162, a keyboard/mouse 1164, and a network interface 1166 via interface (I/F) 1124, I/O Device(s) 1174, smart TV 1176, and consumer electronics 1177 (e.g., PDA, smart phone, tablet, etc.).

In one embodiment, mass storage medium 1162 includes, but is not limited to, a solid state drive, a hard disk drive, a universal serial bus flash memory drive, or any other form of computer data storage medium. In one embodiment, network interface 1166 is implemented by any type of well known network interface standard including, but not limited to, an Ethernet interface, a universal serial bus (USB) interface, a Peripheral Component Interconnect (PCI) Express interface, a wireless interface and/or any other suitable type of interface. In one embodiment, the wireless interface operates in accordance with, but is not limited to, the IEEE 802.11 standard and its related family, Home Plug AV (HPAV), Ultra Wide Band (UWB), Bluetooth, WiMax, or any form of wireless communication protocol.

While the modules shown in FIG. 11 are depicted as separate blocks within the system 1100, the functions performed by some of these blocks may be integrated within a single semiconductor circuit or may be implemented using two or more separate integrated circuits. For example, although cache memory 1116 is depicted as a separate block within processor 1110, cache memory 1116 (or selected aspects of 1116) can be incorporated into processor core 1112.

Figure 12:
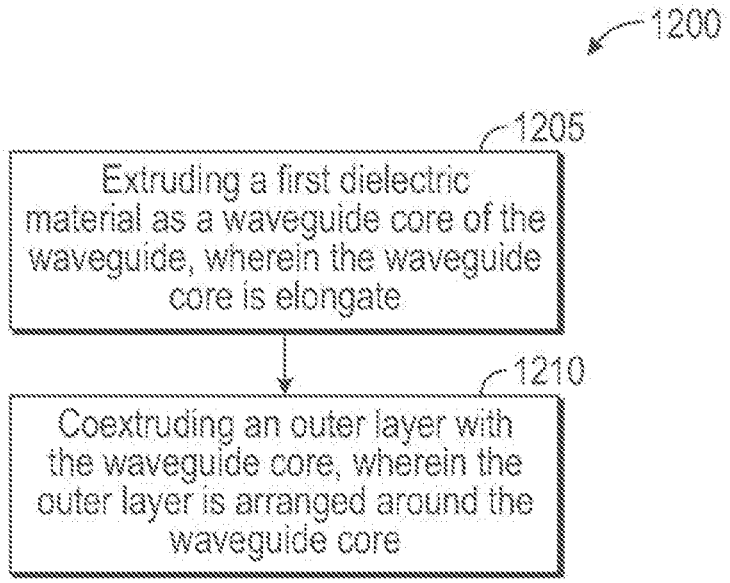
FIG. 12 is a flow diagram of a method making a waveguide in accordance with some embodiments.

FIG. 12 is a flow diagram of a method 1200 of making a waveguide. At step 1205, a first dielectric material is extruded for a waveguide core of the waveguide. The waveguide core is elongate. In some embodiments, the waveguide core is extruded to have a length greater than 0.5 m. The first dielectric material can be any of the dielectric materials described previously herein. At step 1210, an outer layer is coextruded with the waveguide core. The outer layer can be arranged around the waveguide core as shown in the example embodiment of FIG. 2. The outer layer can be a conductive layer as described in regard to FIG. 2, or the outer layer can be a metal particle filled polymer as described in regard to FIG. 3. In other embodiments, the outer layer can be a polymer that includes a metal catalyst as described in regard to FIG. 4, or the outer layer can be a porous polymer shell or a removable shell as described in regard to FIG. 6.

ADDITIONAL DESCRIPTION AND EXAMPLES

Example 1 can include subject matter (such as a method of making a waveguide) comprising extruding a first dielectric material as a waveguide core of the waveguide, wherein the waveguide core is elongate; and coextruding an outer layer with the waveguide core, wherein the outer layer is arranged around the waveguide core.

In Example 2, the subject matter of Example 1 optionally includes coextruding an outer layer that includes an electrically conductive material.

In Example 3, the subject matter of Example 2 optionally includes the coextruded outer layer includes a blend of metal particles and one of the first dielectric material or a second dielectric material, and wherein the method further includes sintering the waveguide to form a continuous metal outer coating.

In Example 4, the subject matter of one or any combination of Examples 1-3 optionally includes the outer layer including a metal catalyst, and wherein the method further includes electroplating a metal coating onto the outer layer.

In Example 5, the subject matter of one or any combination of Examples 1-4 optionally includes forming a plurality of waveguides including waveguide cores with coextruded outer layers.

In Example 6, the subject matter of Example 5 optionally includes embedding the plurality of waveguides in an outer shell of flexible material.

In Example 7, the subject matter of Example 6 optionally includes the outer shell includes a porogen material and the method further includes heating the flexible outer shell and porogen material to form void regions to decouple the outer layers of the waveguides and the outer shell.

In Example 8, the subject matter of one or any combination of Examples 2-7 optionally includes the outer layer including at least one of copper, gold, silver, or aluminum.

In Examples 9, the subject matter of one or any combination of Examples 1-8 optionally includes extruding a waveguide core having a hollow center.

In Example 10, the subject matter of one or any combination of Examples 1-9 optionally includes extruding a waveguide core having a cross section that is one of circular, oval, elliptical, square or rectangular, and wherein co-extruding the outer layer includes co-extruding an outer layer having a cross section that is concentric with the cross section of the waveguide core.

In Example 11, the subject matter of one or any combination of Examples 1-10 optionally includes extruding a plurality of waveguide cores, and wherein the coextruding includes coextruding an outer layer on the waveguide cores that includes at least one of a removable material or a porogen filled material, and wherein the method further includes embedding the plurality of waveguide cores in a flexible material and heating the embedded waveguide cores to activate the porogen.

In Example 12, the subject matter of Example 11 optionally includes metalizing an outer surface of the embedded waveguide cores.

Example 13 can include subject matter (such as an apparatus), or can optionally be combined with one or any combination of Examples 1-12 to include such subject matter comprising at least one waveguide including: an elongate waveguide core including a dielectric material; and an outer layer arranged around the waveguide core, wherein the outer layer is a layer coextruded with the waveguide core.

In Example 14, the subject matter of Example 13 optionally includes the waveguide core including a cross section that is one of circular, oval, elliptical, square or rectangular, and wherein co-extruding the outer layer includes co-extruding an outer layer having a cross section that is concentric with the cross section of the waveguide core.

In Example 15, the subject matter of Example 14 optionally includes a waveguide core including a hollow center.

In Example 16, the subject matter of one or any combination of Examples 13-16 optionally includes the dielectric material of the waveguide core includes at least one of polyethylene (PE), polytetrafluoroethylene (PTFE), perfluoroalkoxy alkanes (PFA), fluorinated ethylene propylene (FEP), polyvinylidene fluoride (PVDF), liquid crystal polymer (LCP), or ethylene-tetraflouroethylene (ETFE).

In Example 17, the subject matter of one or any combination of Examples 13-16 optionally includes an outer layer that includes a metal on an outer surface of the outer layer.

In Example 18, the subject matter of Example 17 optionally includes an outer layer that includes a metal on an outer surface of the outer layer.

In Example 19, the subject matter of one or any combination of Examples 13-18 optionally includes a plurality of waveguides that include extruded waveguide cores with coextruded outer layers, wherein the waveguides are embedded in an outer shell of flexible material, and wherein the outer shell includes regions void of flexible material between the outer layers of the waveguides and the outer shell.

In Example 20, the subject matter of one or any combination of Examples 13-18 optionally includes a plurality of waveguides that include extruded waveguide cores with coextruded outer layers, wherein the waveguides are embedded in an outer shell of flexible material, and wherein the outer layers include a metal catalyst and a surface of the outer layers includes a metal.

In Example 22, the subject matter of one or any combination of Examples 13-21 optionally includes a length of the at least one waveguide of the plurality of waveguides is more than one-half meter (0.5 m).

Example 23 can include subject matter (such as an apparatus), or can optionally be combined with one or any combination of Examples 1-22 to include such subject matter comprising: a waveguide, wherein the waveguide includes: a length of a conductive material; a first groove extending lengthwise in the conductive material; and at least a second groove extending lengthwise in the conductive material, wherein the second groove is arranged opposite the first groove, such that a cross section of the waveguide includes at least a first notch on a first side of the cross section and a second notch in the cross section opposite the first notch.

In Example 24, the subject matter of Example 23 optionally includes conductive material that is an outer layer of the waveguide, and wherein the waveguide includes a waveguide core of dielectric material.

In Example 25, the subject matter of Example 24 optionally includes the outer layer being a layer coextruded with the waveguide core dielectric.

In Example 26, the subject matter of one or any combination of Examples 23-26 optionally includes the location of the first groove and second the second groove change along the length of the waveguide.

In Example 27, the subject matter of one or any combination of Examples 23-26 optionally includes positions of the first groove and second the second groove that continually change along the length of the waveguide.

In Example 28, the subject matter of one or any combination of Examples 23-27 optionally includes a width of the waveguide is two millimeters (2 mm) or less, and the length of the waveguide is one-half meter (0.5 m) or more.

In Example 29, the subject matter of one or any combination of Examples 23-28 optionally includes a waveguide transceiver circuit operatively coupled to the waveguide.

Example 30 includes subject matter (such as an apparatus), or can optionally be combined with one or any combination of Examples 1-29 to include such subject matter comprising a first server and a second server, wherein the first and second servers each include a plurality of ports; and a waveguide operatively coupled to a first port of the first server and a first port of the second server, wherein the waveguide includes: a length of a conductive material; a first groove extending lengthwise in the conductive material; and a second groove extending lengthwise in the conductive material and arranged opposite the first groove, such that a cross section of the waveguide includes a first notch on a first side of the cross section and a second notch in the cross section opposite the first notch.

In Example 31, the subject matter of Example 30 optionally includes the conductive material being an outer layer of the waveguide, and wherein the waveguide includes a waveguide core of dielectric material.

In Example 32, the subject matter of one or both of Examples 30 and 31 optionally includes the location of the first groove and second the second groove changing along the length of the waveguide.

These non-limiting examples can be combined in any permutation or combination.

The Abstract is provided to allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A method of making a waveguide, the method comprising:

extruding a first dielectric material as a waveguide core of the waveguide, wherein the waveguide core is elongate; and coextruding an outer layer that includes an electrically conductive material with the waveguide core, wherein the outer layer is arranged around the waveguide core.

2. The method of claim 1, wherein the extruding includes extruding the waveguide core to have a cross section that is one of circular, oval, elliptical, square or rectangular, and wherein co-extruding the outer layer includes co-extruding an outer layer having a cross section that is concentric with the cross section of the waveguide core.

3. The method of claim 1, further including extruding a plurality of waveguide cores, and coextruding an outer layer on each of the plurality of waveguide cores that includes a porogen filled material, embedding the plurality of waveguide cores in a flexible material and heating the embedded plurality of waveguide cores to activate the porogen.

4. The method of claim 3, including metalizing a respective outer surface of the corresponding outer layers of the plurality of waveguide cores.

5. The method of claim 1, wherein the coextruded outer layer includes a blend of metal particles and one of the first dielectric material or a second dielectric material, and wherein the method further includes sintering the waveguide to form a continuous metal outer coating.

6. The method of claim 1, wherein the outer layer includes a metal catalyst, and wherein the method further includes electroplating a metal coating onto the outer layer.

7. The method of claim 1, further including forming a plurality of waveguides, each waveguide including a respective waveguide core with a corresponding router layer that is coextruded.

8. The method of claim 7, including embedding the plurality of waveguides in an outer shell of flexible material.

9. The method of claim 8, wherein the outer shell includes a porogen material and the method further includes heating the flexible outer shell and porogen material to form void regions to decouple the corresponding outer layers of the respective waveguide core of the plurality of waveguides and the outer shell.

10. The method of claim 1, wherein the outer layer includes at least one of copper, gold, silver, or aluminum.

11. The method of claim 1, wherein the extruding includes extruding the waveguide core to have a hollow center.

12. An apparatus comprises a plurality of waveguides, each waveguide including:

a respective elongate extruded waveguide core including a dielectric material; and a corresponding outer layer arranged around the respective waveguide core and coextruded with the respective extruded waveguide core, wherein the corresponding outer layer includes an electrically conductive material;

wherein the plurality of waveguides are embedded in an outer shell of flexible material, and wherein the outer shell includes regions void of flexible material between the corresponding outer layers of the plurality of waveguides and the outer shell.

13. The apparatus of claim 12, including a waveguide transceiver circuit operatively coupled to at least one waveguide of the plurality of waveguides.

14. The apparatus of claim 12, wherein the respective outside s layer of each waveguide of the plurality of waveguides includes a metal catalyst and a respective surface of the corresponding outer layer includes a metal.

15. The apparatus of claim 14, wherein a length of the plurality of waveguides is more than one-half meter (0.5 m).

16. The apparatus of claim 12, wherein the respective elongate extruded waveguide core includes a cross section that is one of circular, oval, elliptical, square or rectangular, and wherein the corresponding outer layer of the respective waveguide core includes a cross section that is concentric with the cross section of the respective waveguide core.

17. The apparatus of claim 16, wherein the respective elongate extruded waveguide core includes a hollow center.

18. The apparatus of claim 12, wherein the dielectric material of the respective elongate extruded waveguide core includes at least one of polyethylene (PE), polytetrafluoroethylene (PTFE), perfluoroalkoxy alkanes (PFA), fluorinated ethylene propylene (FEP), polyvinylidene fluoride (PVDF), liquid crystal polymer (LCP), or ethylene-tetraflouroethylene (ETFE).

19. The apparatus of claim 12, wherein the electrically conductive material of the respective outer layer includes a metal on an outer surface of the outer layer.

20. The apparatus of claim 12, wherein the electrically conductive material of the respective outer layer includes a conductive polymer.

21. An apparatus comprising: a waveguide, wherein the waveguide includes: a length of a conductive material having an outer surface; a first groove in and including the conductive material extending lengthwise along the outer surface of the waveguide; and at least a second groove in and including the conductive material extending lengthwise along the outer surface of the waveguide, wherein the second groove is arranged opposite the first groove, such that a cross section of the waveguide includes at least a first notch on a first side of the cross section and a second notch in the cross section opposite the first notch.

22. The apparatus of claim 21, wherein the conductive material is an outer layer of the waveguide, and wherein the waveguide includes a waveguide core of dielectric material.

23. The apparatus of claim 22, wherein the outer layer is a layer coextruded with the waveguide core dielectric.

* * * * *